US007480943B2

(12) United States Patent
Schmadeka

(10) Patent No.: US 7,480,943 B2
(45) Date of Patent: Jan. 27, 2009

(54) MULTI-PURPOSE BALL MITT

(76) Inventor: Jerald D. Schmadeka, 5105 NE. 39th Ave., Vancouver, WA (US) 98661

( * ) Notice: Subject to any disclaimer, the term of this patent is extended or adjusted under 35 U.S.C. 154(b) by 328 days.

(21) Appl. No.: 11/105,936

(22) Filed: Apr. 13, 2005

(65) Prior Publication Data

US 2006/0230486 A1 Oct. 19, 2006

(51) Int. Cl.
*A41D 13/08* (2006.01)

(52) U.S. Cl. ..... 2/19; 2/161.1

(58) Field of Classification Search ..... 2/16–21, 2/159–160, 161.1, 164; 473/458
See application file for complete search history.

(56) References Cited

U.S. PATENT DOCUMENTS 4,637,610 A * 1/1987 Carr ..... 473/458
5,012,529 A * 5/1991 Murai ..... 2/18
5,402,537 A * 4/1995 Kolada ..... 2/19
5,551,083 A * 9/1996 Goldsmith ..... 2/19
5,572,739 A * 11/1996 Kolada et al. ..... 2/19
5,687,421 A * 11/1997 Murai ..... 2/19
5,689,828 A * 11/1997 Mah ..... 2/16
5,956,771 A * 9/1999 Barbera ..... 2/161.1
6,006,358 A * 12/1999 Keating ..... 2/161.1
6,571,394 B1 6/2003 Hackett et al.
6,640,339 B1 11/2003 Gilligan
2003/0056273 A1 * 3/2003 Kleinert ..... 2/19

* cited by examiner

*Primary Examiner*—Gary L Welch
*Assistant Examiner*—Andrew W Sutton
(74) *Attorney, Agent, or Firm*—Lee Hong Degerman Kang & Waimey

(57) ABSTRACT

A ball mitt for catching a ball is disclosed. The ball mitt comprises a first ball glove having an attaching fastener; and a second ball glove having a receiving fastener that is detachably connected to the attaching fastener, wherein the second ball glove has a receiving portion adapted to receive a user's hand.

26 Claims, 2 Drawing Sheets

FIG. 4
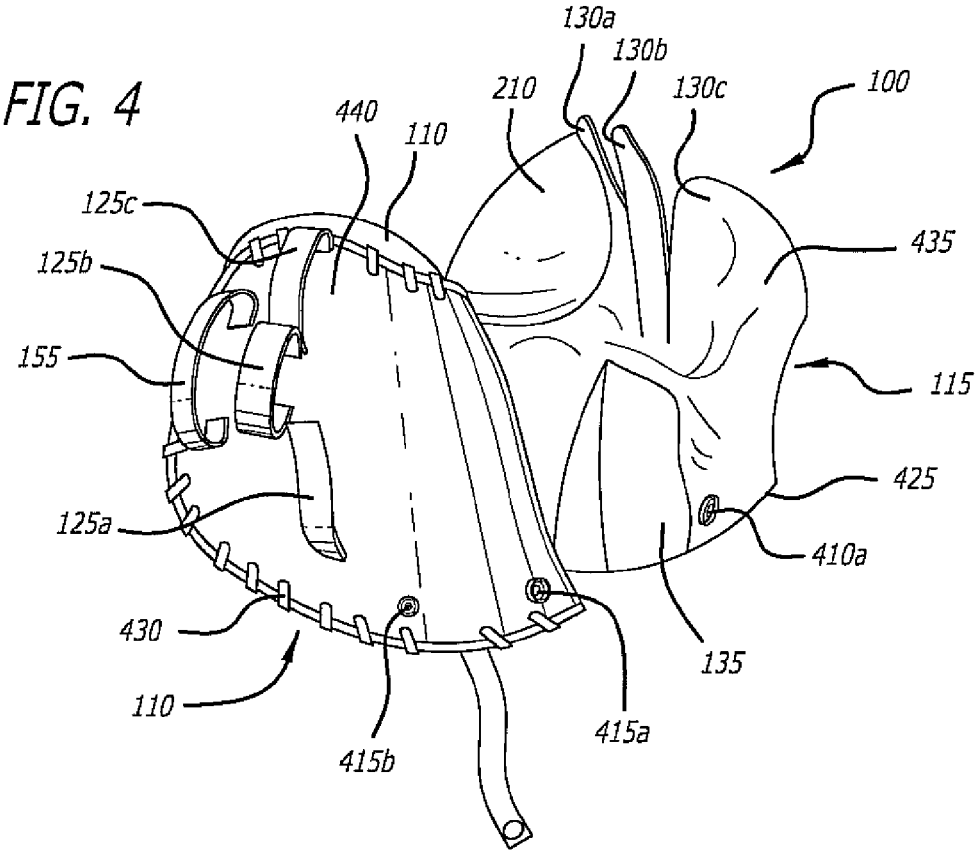
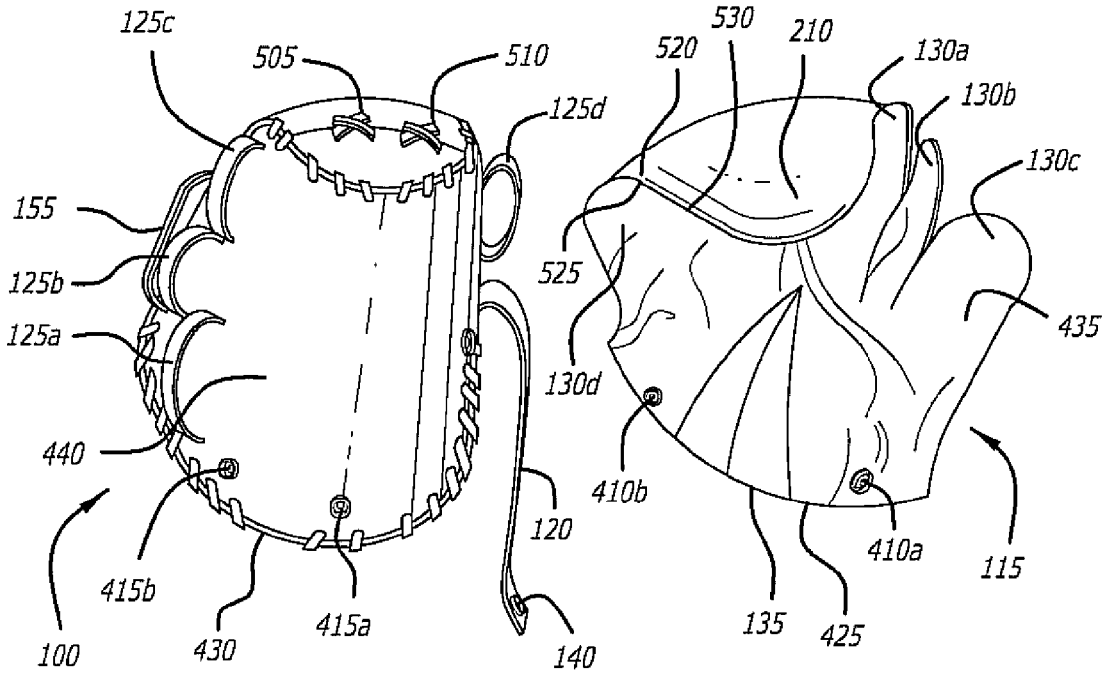
FIG. 5

MULTI-PURPOSE BALL MITT

BACKGROUND OF THE INVENTION

1. Field of the Invention

The present invention relates to a multi-purpose ball mitt, and more particularly, to a multi-purpose ball mitt that is constructed of two or more ball gloves detachably connected, which facilitates a glove having improved fielding capacity.

2. Description of the Related Art

There are currently a large variety of ball mitts or gloves. For example, a conventional catcher's mitt fields high velocity balls between a set of thick pads attached to opposing sides of the mitt. A conventional fielder's glove fields low velocity balls in a large web pocket. The large web pocket receives balls that arrive at various angles and directional orientations, resulting from the ball contacting a ball field surface, such as soil within the infield or grass in the outfield.

In recent years, improvements have been made in related art ball gloves to increase the level of ball play. For example, a catcher's mitt has been designed with reduced padding, on one or both sides. A ball glove uses a padded element, which cushions the impact of a ball against a soft part of a person's hand. In another example, a double-hinged assembly of a ball glove traps or secures a ball within one of several regions of the mitt. Still another variety of ball mitts has a padded region disposed with a single hinge assembly region for field balls traveling at higher velocities. Fielding gloves have been produced with fingerstalls and thumb sections for increasing a user's comfort while catching a ball as well as providing improved ball handling capability.

Each of these related art glove designs are complex. Furthermore, the related art glove designs have their functionality and usefulness limited to specific ball fielding conditions. It would be desirable to have a ball mitt that has a simple design, and is usable under a variety of ball fielding conditions, which depend on, for example, the motion of the fielded ball, as well as provide an improved level of ball performance over related art ball gloves.

SUMMARY OF THE INVENTION

Features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

In one embodiment, a ball mitt for catching a ball is disclosed. The ball mitt comprises a first ball glove having an attaching fastener, and a second ball glove having a receiving fastener that is detachably connected to the attaching fastener, wherein the second ball glove has a receiving portion adapted to receive a user's hand.

In another embodiment, a ball mitt for increasing the level of play during a ball game is disclosed. The ball mitt comprises a first ball glove having an attaching fastener disposed proximal to an edge of a rear surface of the first ball glove, opposing padded zones disposed substantially parallel that align along the edges of the first ball glove to form a pocket for catching the ball, and spaced apart loops on an outer rear surface of the first ball glove. A second ball glove is provided having a receiving fastener disposed proximal to an edge of a front surface of the second ball glove that is adapted for reception of a user hand. The attaching fastener and the receiving fastener are disconnectedly attached to each other.

Additional features and advantages of the invention will be set forth in the description which follows, and in part will be apparent from the description, or may be learned by practice of the invention. It is to be understood that both the foregoing general description and the following detailed description of the present invention are exemplary and explanatory and are intended to provide further explanation of the invention as claimed.

These and other embodiments will also become readily apparent to those skilled in the art from the following detailed description of the embodiments having reference to the attached figures, the invention not being limited to any particular embodiments disclosed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

Features, elements, and aspects of the invention that are referenced by the same numerals in different figures represent the same, equivalent, or similar features, elements, or aspects in accordance with one or more embodiments.

FIG. 4 illustrates a rear view of a first ball glove and a partial front view of the second ball glove upon detachment in accordance with one embodiment of the present invention.

FIG. 5 illustrates a rear view that shows an attaching fastener of the first ball glove and an receiving fastener of the second ball glove in accordance with one embodiment of the present invention.

DETAILED DESCRIPTION OF THE PREFERRED EMBODIMENTS

A ball mitt that has at least two ball gloves is disclosed. More particularly, the invention relates to a ball mitt that is constructed of a first ball glove that is detachably connected to a second ball glove. The detachable connection allows a user the opportunity to select, before or during ball play, the proper glove depending on a motion of the ball that is being fielded. It should be noted that even though the following exemplary embodiment uses a first and a second ball glove, the same detachable connection principles may be utilized wherever there is a need for detachably connecting two or more gloves to facilitate improved sports play or increasing the economy of ball play, such as allowing a ball player to utilize the ball mitt for various ball fielding positions.

Reference will now be made in detail to the preferred embodiments of the present invention, examples of which are illustrated in the accompanying drawings.

Figure 1:
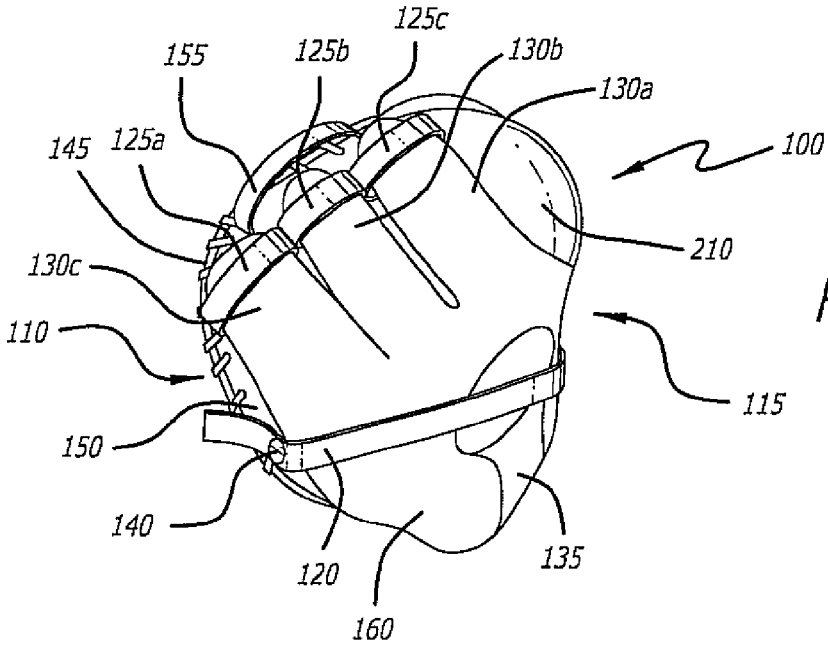
FIG. 1 illustrates a perspective rear view of a second ball glove of the ball mitt and an opening for reception of a user's hand in accordance with one embodiment of the present invention.

Referring to FIG. 1, the ball mitt 100 comprises a first ball glove 110 and a second ball glove 115. In this example, a rear surface 440 of the first ball glove 110, for example a first rear shell, mates with a front surface 435 of the second ball glove 115, for example a second front shell (see FIG. 4). In this embodiment, the first ball glove 110 fields a ball, not shown.

A strap 120 detachably connected through a strap fastener 140 secures together the first ball glove 110 and the second ball glove 115. Spaced apart loops 125*a*, 125*b*, 125*c*, for example finger stalls for holding, respectively, a ring finger, a middle finger, and a index finger of a user, which are disposed on the first ball glove 110. The spaced apart loops 125*a*, 125*b*, and 125*c* provide openings for insertion of finger projections 130*a*, 130*b*, 130*c* of the second ball glove 115 to substantially secure the first ball glove 110 to the second ball glove 115. In this example, the spaced apart loops 125*a*, 125*b*, and 125*c* are disposed proximal to an edge 145 of a rear shell 150 of the first ball glove 110. The finger projections 130*a*, 130*b*, and 130*c* are extended, in this example, from the second ball glove 115 opposite from a receiving end 135. The receiving end 135 receives a user's hand (not shown). A release loop 155, which is disposed proximal to an edge of the first ball glove 110, provides a capability of detaching the first ball glove 110 from the second ball glove 115.

Figure 2:
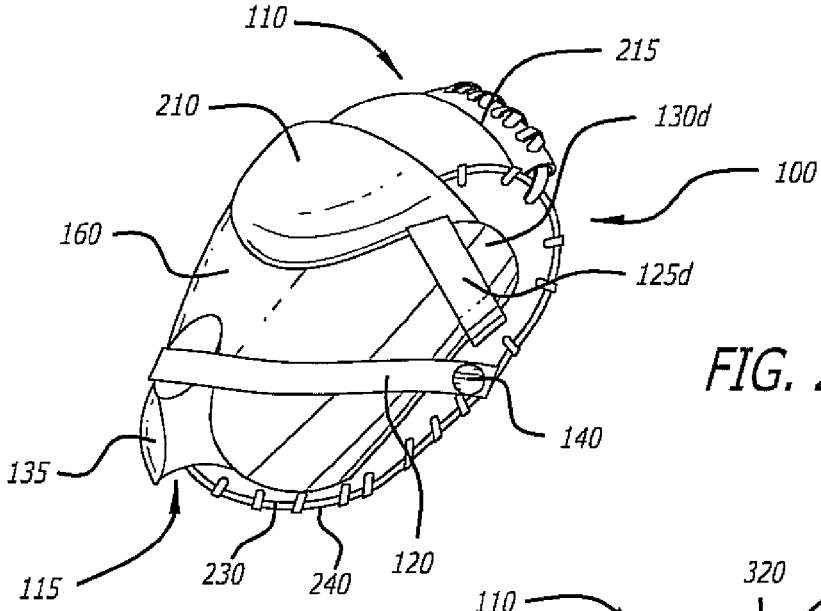
FIG. 2 illustrates a perspective side view of the ball mitt depicting a strap and the second ball glove in accordance with one embodiment of the present invention.

Referring to FIG. 2, the second ball glove 115 has webbing 210 for fielding an incoming ball, not shown. A spaced apart loop 125*d* mates with a thumb projection 130*d*, for example a thumb stall, from the second ball glove 115 for securing a user's thumb, not shown, received by the second ball glove 115. The first ball glove 110 has webbing 215 for fielding an incoming ball, not shown. The second ball glove 115 has a rear surface 160, for example a second rear shell, for contacting the strap 120 while the first ball glove 110 is in use. The first ball glove 110 has a rear surface 150, for example a first rear shell, that is substantially joined along an edge 145, for example an intersection of a first rear shell edge 230 and a first front shell edge 240, as shown in FIGS. 1-2. The second ball glove 115 has a rear surface 160, for example a second rear shell, that is substantially joined along an edge 530, for example an intersection of a second rear shell edge 525 and a second front shell edge 520, as shown in FIG. 5.

Figure 3:
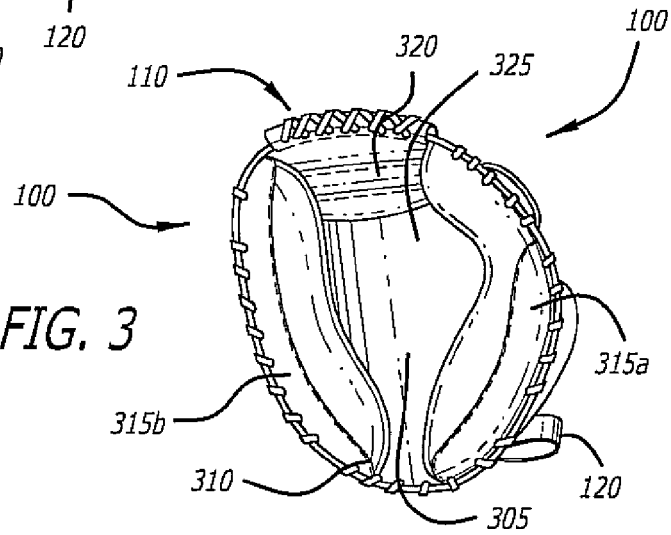
FIG. 3 illustrates a front view of the ball mitt in accordance with one embodiment of the present invention.

Referring to FIGS. 3-5, the first ball glove 110 has a front surface 305, for example a first front shell, and a ball pocket 325. The ball pocket 325 is formed by a volume created between pads 315*a*, 315*b*. Attaching fasteners 415*a*, 415*b*, for example first snap fasteners, are disposed proximal to an edge 430 of the first ball glove 110. Receiving fasteners 410*a*, 410*b*, for example second snap fasteners that mate with first snap fasteners, are disposed proximal to an edge 425 of the second ball glove 115 secure the strap 120 to the second ball glove 115.

In a first embodiment, the attaching fasteners 415*a*, 415*b* are coupled to receiving fasteners 410*a*, 410*b* to secure the first ball glove 110 to the second ball glove 115. In an alternative example of the first embodiment, strap 120 is optionally connected to the strap fastener 140 to further secure the first ball glove. Referring to FIG. 3, the first ball glove 110 receives the incoming ball, not shown, on a front surface 305 within the pocket 325.

In a second embodiment, the strap 120, if connected, is disconnected from the first ball glove 110. A release loop 155, disposed on the first ball glove 110, receives a user's hand, not shown. The user hand, not shown, pulls the release loop 155 away from the edge 145 for disconnecting the finger projections 130*a*, 130*b*, 130*c* and thumb projection 130*d* from the spaced apart loops 125*a*, 125*b*, 125*c*, 125*d*. Referring to FIG. 5, the second ball glove 115 receives the incoming ball, not shown, on a front surface 435 between a catching volume formed between the finger projections 130*a*, 130*b*, 130*c* and the thumb projection 130*d* and the front surface 435. In this embodiment, the second ball glove 115 receives an incoming ball, not shown. In one example, the second ball glove 115 may be used in response to a user determining that the incoming ball is a pop-fly. In one exemplary example, the incoming ball is a softball or a baseball. In another example, if the first ball glove 110 is a catcher's mitt and the second ball glove 115 is a fielder's mitt, a ball needs to be preferably fielded with the second ball glove 115.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

In one example of the present invention, attaching fasteners and receiving fasteners as described above, may be equivalently replaced using other attachment methods such as hook-and-loop fasteners, hooks, coupling fasteners, latches, or other similar connection type apparatuses. In another example of the present invention, attaching fasteners may be located on a second ball glove and the receiving fasteners may be disposed on a first ball glove. Furthermore, the principles of the ball mitt that are herein disclosed may be utilized for any ball sport that involves catching or fielding balls.

What is claimed is:

1. A ball mitt for catching a ball, comprising:

a first ball glove comprising opposing padded zones disposed along edges of the first ball glove to form a pocket for receiving a ball during a first ball-playing situation, the first ball glove having an attaching fastener; and a second ball glove comprising webbing connecting a finger projection and a thumb projection of the second ball glove for receiving the ball during a second ball-playing situation, the second ball glove having a receiving portion adapted to receive a user's hand and a receiving fastener for detachably connecting with the attaching fastener of the first ball glove, wherein the detachable connection between the first ball glove and the second ball glove enables the user to use the first ball glove and the second ball glove in a connected state to receive the ball in the first ball glove during the first ball-playing situation and selectively detach the first ball glove from the second ball glove to receive the ball in the second ball glove during the second ball-playing situation, wherein the first ball glove further comprises a first front shell having a first front shell edge, a first rear shell having a first rear shell edge that is substantially joined along the first front shell edge, and the attaching fastener is disposed on an exterior surface of the first rear shell.

2. The ball mitt of claim 1, wherein the first ball glove is a catcher's mitt and the second ball glove is a fielder's mitt.

3. The ball mitt of claim 1, wherein the attaching fastener is a first snap fastener disposed proximal to an edge of a rear surface of the first ball glove and the receiving fastener is a second snap fastener that is mated with the first snap fastener disposed proximal to an edge of a front surface of the second ball glove.

4. The ball mitt of claim 1, wherein the attaching fastener comprises spaced apart loops disposed proximal to an edge of a rear surface of the first ball glove.

5. The ball mitt of claim 4, wherein the receiving fastener comprises finger projections that are extended from an end of the second ball glove opposite to that of the receiving portion of the second ball glove and received by the attaching fastener.

6. The ball mitt of claim 4, further comprising a strap detachably attached at a first end proximal to a first edge of a rear surface of the first ball glove and at a second end to a second edge of a rear surface of the first ball glove, wherein the strap is extended across a rear surface of the second ball glove.

7. The ball mitt of claim 1, the second ball glove comprising:

a second front shell having a second front shell edge and a selected portion of the second front shell edge for receiving a user's fingers;

a second rear shell having a second rear shell edge and a selected portion of the second rear shell for receiving a user's fingers;

the second rear shell edge and the second front shell edge are substantially joined along the edges; and the receiving fastener is disposed on the inner surface of the second front shell.

8. The ball mitt of claim 7, wherein the selected portion of the second front shell edge and the second rear shell edge comprises:

three finger stalls for reception of a ring finger, a middle finger, and an index finger, the three finger stalls are received into spaced apart loops disposed proximal to the first front shell edge and the first rear shell edge.

9. The ball mitt of claim 1, wherein the first ball glove comprises spaced apart loops on an outer rear surface of the first ball glove.

10. The ball mitt of claim 9, wherein the second ball glove comprises finger stalls for reception of a ring finger, a middle finger, and an index finger and insertion into the spaced apart loops.

11. The ball mitt of claim 1, wherein the second ball glove is detached from the first ball glove in response to a user determining the second ball glove is more suitable for increasing a level of ball play.

12. The ball mitt of claim 2, wherein the second ball glove is detached from the first ball glove in response to a user determining a ball in motion is a pop-fly.

13. The ball mitt of claim 1, further comprising a release loop, which is pulled to detach the first ball glove from the second ball glove.

14. A ball mitt for catching a ball, comprising:

a first ball glove comprising opposing padded zones disposed along edges of the first ball glove to form a pocket for receiving a ball during a first ball-playing situation;

a second ball glove comprising webbing connecting a finger portion and a thumb portion of the second ball glove for receiving the ball during a second ball-playing situation, the second ball glove providing a receiving portion to receive a user's hand; and a detachable connecting means for allowing the user to use the first ball glove and the second ball glove in a connected state during the first ball-playing situation and detach the first ball glove from the second ball glove in response to the user's decision that the second ball glove provides an increased level of ball play as compared to using the first ball glove during the second-ball playing situation, wherein the first ball glove further comprises a first front shell having a first front shell edge and a first rear shell having a first rear shell edge that is substantially joined along the first front shell edge.

15. The ball mitt of claim 14, wherein the first ball glove is a catcher's mitt and the second ball glove is a fielder's mitt.

16. The ball mitt of claim 14, wherein the detachable connecting means comprises:

an attaching means disposed proximal to an edge of a rear surface of the first ball glove, and a mating means that is disposed proximal to an edge of a front surface of the second ball glove and inserted into the attaching means for securing the second ball glove to the first ball glove.

17. The ball mitt of claim 14, wherein the detachable connecting means comprises:

a looped strap attaching means disposed proximal to an edge of a rear surface of the first ball glove, and a finger projection means extended from the receiving portion that is insertable into the looped strap attaching means for securing the first ball glove to the second ball glove.

18. The ball mitt of claim 14, wherein the detachable connecting means comprises a loop strap attaching means disposed on an outer rear surface of the first ball glove.

19. The ball mitt of claim 18, wherein the second ball glove comprises a finger stall means for reception of a ring finger, a middle finger, and an index finger and insertion into the loop strap attaching means.

20. The ball mitt of claim 14, wherein the second ball glove is detached from the first ball glove in response to a user determining the second ball glove is more suitable for increasing a level of ball play.

21. A ball mitt for increasing the level of play during a ball game, the ball mitt comprising:

a first ball glove for receiving a ball during a first ball-playing situation and having an attaching fastener disposed proximal to an edge of a rear surface of the first ball glove, opposing padded zones disposed substantially parallel that align along the edges of the first ball glove to form a pocket for catching the ball, and spaced apart loops on an rear surface of the first ball glove;

a second ball glove comprising webbing connecting a finger portion and a thumb portion of the second ball glove for receiving the ball during a second ball playing-situation, the second ball glove having a receiving fastener disposed proximal to an edge of a front surface of the second ball glove and adapted for reception of a user hand; and a release loop disposed on the first ball glove;

wherein the attaching fastener and the receiving fastener are disconnectively attached to each other such that the user is able to use the first ball glove and the second ball glove in a connected state to receive the ball in the first ball glove during the first ball-playing situation and selectively detach the first ball glove from the second ball glove to receive the ball in the second ball glove during the second ball-playing situation, wherein the first ball glove further comprises a first front shell having a first front shell edge and a first rear shell having a first rear shell edge that is substantially joined along the first front shell edge.

22. The ball mitt of claim 21, wherein the second ball glove comprises a finger stall means for reception of a ring finger, a middle finger, an index finger and thumb stall for reception of a thumb and wherein the finger stall means and the thumb stall are inserted into the spaced apart loops.

23. The ball mitt of claim 22, wherein the second ball glove is detached from the first ball glove in response to a user pulling on the release loop.

24. The ball mitt of claim 23, wherein the ball mitt is a baseball mitt.

25. The ball mitt of claim 4, wherein the ball mitt is at least one of a baseball mitt and a softball mitt.

26. The ball mitt of claim 18, wherein the bail mitt is at least one of a baseball mitt and a softball mitt.

* * * * *